United States Patent [19]

Snellman et al.

[11] 4,077,078

[45] Mar. 7, 1978

[54] BOOK COVER APPLICATOR

[76] Inventors: Donald L. Snellman, 2807 W. Galer, Seattle, Wash. 98199; John C. Kuspert, 8844 36th SW., Seattle, Wash. 98126

[21] Appl. No.: 662,321

[22] Filed: Mar. 1, 1976

[51] Int. Cl.[2] ..... B42C 19/00; B42C 11/02

[52] U.S. Cl. ..... 11/1 AD; 11/4; 281/21 R

[58] Field of Search ..... 11/4, 5, 1 AD, 1 R; 281/21, 29

[56] References Cited

U.S. PATENT DOCUMENTS 1,879,757 9/1932 Ilusch ..... 11/1 AD 1,931,244 10/1935 Alger et al. ..... 11/1 AD 3,093,396 6/1963 Segreto ..... 281/21 R

*Primary Examiner*—Stephen C. Pellegrino

[57] ABSTRACT

The book cover applicator is suitable for use in applying covers to multiple sheet fillers which have been secured together along the spine by a hotmelt adhesive. The applicator includes clamps for securing the filler and cover at a cover application station, a heater bar for applying heat to melt the hotmelt adhesive, and a blower for cooling the melted hotmelt adhesive to ambient temperature. The hotmelt adhesive provides a strong, flexible bond between the filler spine and the cover.

15 Claims, 15 Drawing Figures

BOOK COVER APPLICATOR

BACKGROUND OF THE INVENTION

This invention relates to bookbinding and, more particularly, to book cover applicators for applying covers to fillers or book blocks which may be made up of a stack of sheets, signatures or folios which have been secured together along one edge. The invention is suitable for use in making hard cover books, paper backs, notebook pads, pamphlets and the like.

Modern bookbinding machines are complex generally automated devices designed primarily for large scale mass production bookbinding operations in which sheets are fed to a holding device, and assembled into multiple sheet signatures or folios which are then stitched and bound to covers. These machines, however, cannot be used effectively and economically in small scale bookbinding operations in which limited numbers of books or the like are to be bound. Books of this type are commonly assembled by a sheet sorter or collator which operates in line with a duplicator or press and deposits the sheets in stacks into an array of receiving bins, jogs the stacked sheets so as to align at least one of their edges in a single plane, and secures or bonds the sheets together along the one aligned edge or spine to form a book block or filler. Until this invention, book covers have commonly been applied to this type of book in small scale bookbinding operations almost entirely by hand.

As used in this specification the terms "book block" and "filler" are synonomous and mean a stack of individual sheets, bound or stitched folios, or signatures which have been bonded together along one edge forming the spine. A "book" will be understood to comprise a "filler" or "block" and a "cover" bonded to the filler or block along its spine.

SUMMARY OF THE INVENTION

This invention provides a book cover applicator and method for applying book covers to multiple sheet fillers in which the sheets or signatures are secured together along the entire spine or at selected locations by an adhesive which also serves to bind together the filler and cover. The spine is coated entirely or at spaced intervals with a selectively activatable adhesive. One such adhesive, hereinafter referred to as a "hotmelt" adhesive, is a heat activatable adhesive which is liquid at temperatures above its melting point but which is a solid polymer at ambient temperature. The book cover applicator of this invention can be used effectively and economically to rapidly apply covers to books in batches suitable for commercial requirements.

In a preferred embodiment of the invention, the cover is folded about and conformably engaged with the filler spine while simultaneously therewith heat is applied to melt the hotmelt adhesive. Once the adhesive is melted sufficiently to adhere the filler spine and cover surface, heat application is terminated and the adhesive is cooled until set sufficiently to provide a strong, flexible bond. While manual feeding of the covers and fillers is illustrated and described, automated feeding or conveying apparatus may be provided, if desired.

DETAILED DESCRIPTION OF THE PREFERRED EMBODIMENT

Figure 1:
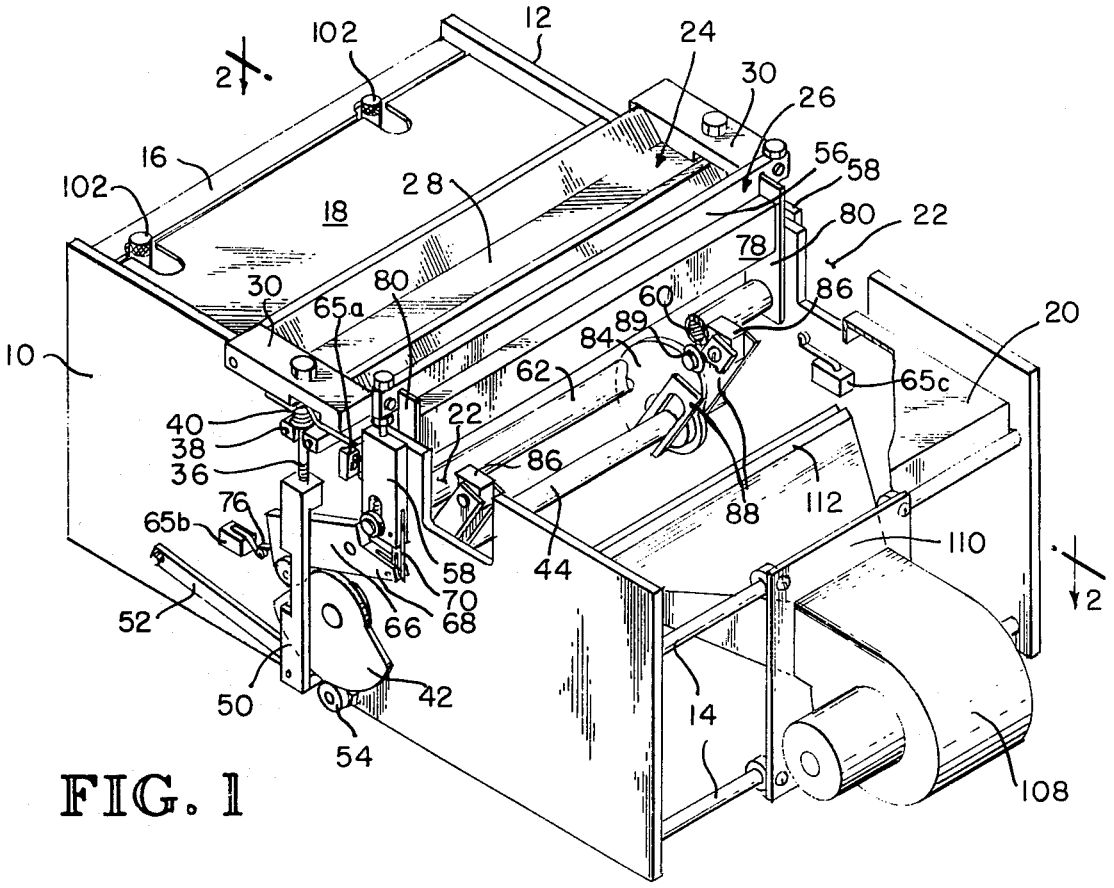
FIG. 1 is a perspective view of the book cover applicator of this invention with parts broken away.
Figure 2:
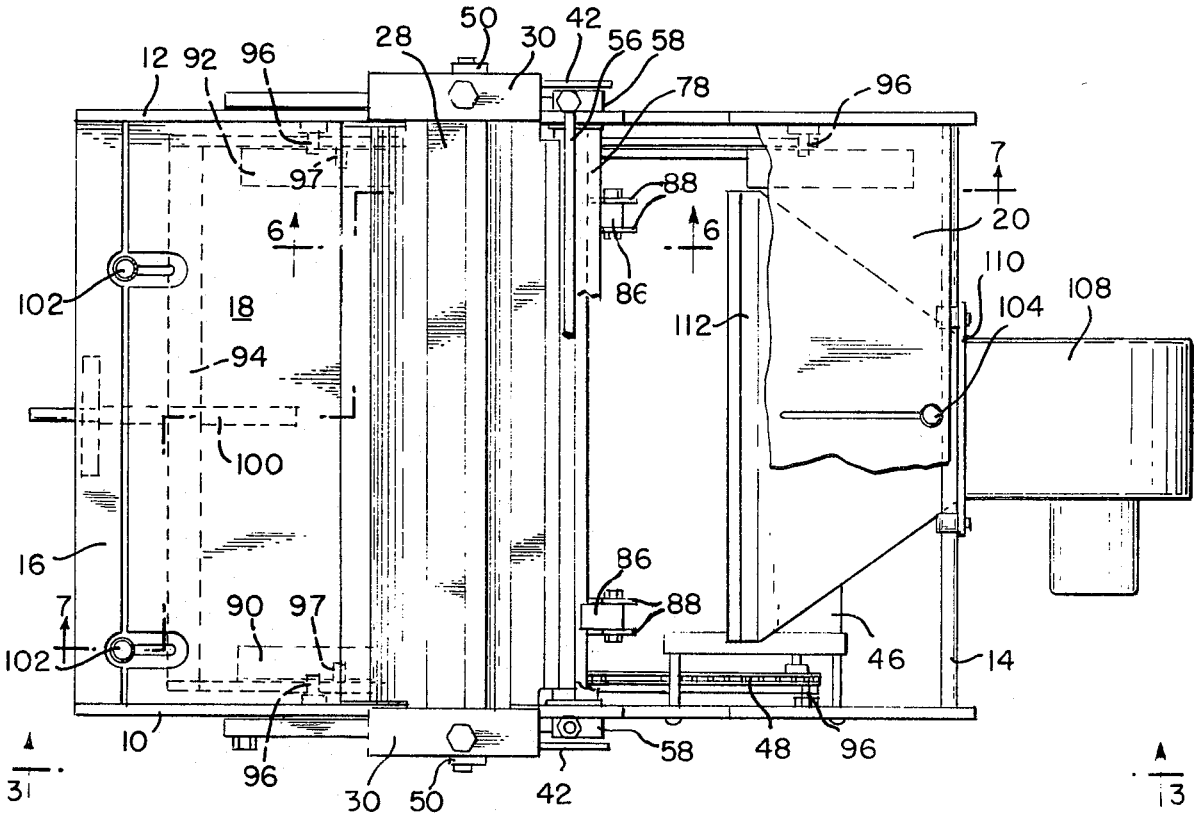
FIG. 2 is a top view of the book cover applicator of FIG. 1 taken along lines 2—2 of FIG. 1 with parts broken away.
Figure 3:
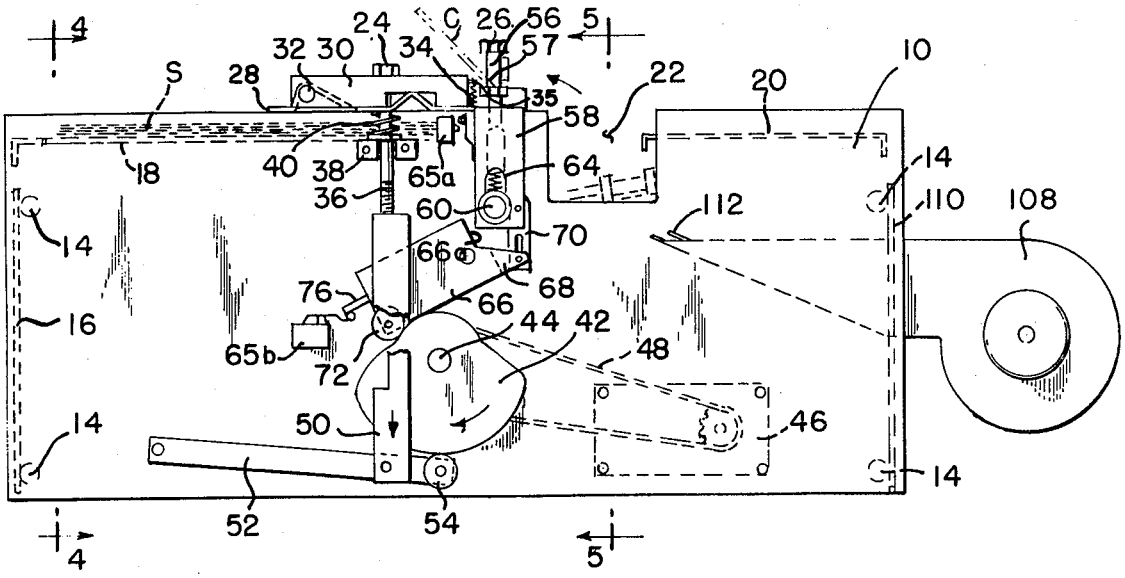
FIG. 3 is a side elevational view of the book cover applicator of FIG. 1 taken along lines 3—3 of FIG. 2.
Figure 6:
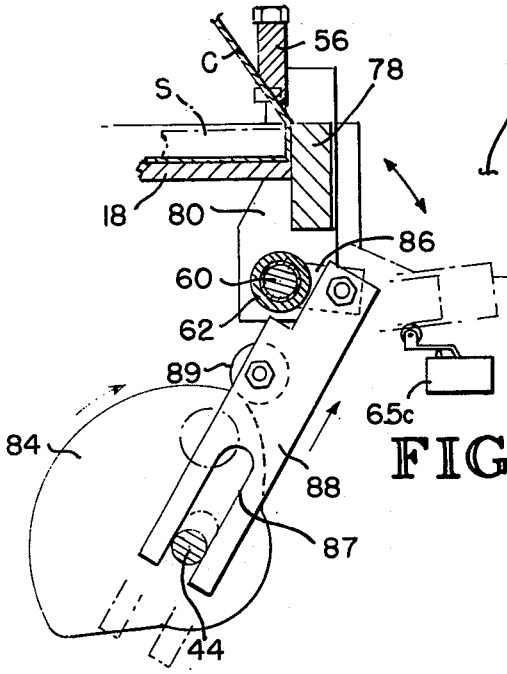
FIG. 6 is a cross-section taken along lines 6—6 of FIG. 2.

The book cover applicator of FIGS. 1–3 includes a generally rectangular housing open at its rear end (right end as viewed in FIG. 1) and upper midsection. The housing is made up of two mutually parallel left and right side walls 10 and 12 respectively spaced apart at their ends by two pairs of transverse end rods 14 therebetween. A U-shaped front wall 16 is secured to the forward two rods 14. Forward and rear horizontal support plates 18 and 20 respectively extend between the forward and rearward upper edge portions of the side walls. These support plates are spaced longitudinally from each other by mutually opposed generally U-shaped recesses 22 in the upper edges of the side walls intermediate the lengths thereof. A multiple sheet filler or block S having hot melt adhesive applied to its spine, (FIG. 3) is laid flat on the forward support plate 18 with its spine adjacent a cover application station. This station extends in a line transversely across the applicator housing adjacent the rear edge of the forward support plate 18, as shown (FIG. 6). As most clearly shown in FIG. 8, a cover C which is to be secured adhesively to the spine of the filler is also laid flat upon the two support plates: one-half underneath the filler S between the latter and the top surface of the support plate 18, the other half bridging the side wall recessess 22 and resting partially on the top of the rear support plate 20. The middle portion of cover C is scored such that the cover C is foldable in half conformably about the filler spine, as shown (FIG. 6). The filler S and cover C are laid upon and removed from the book cover applicator one at a time in manual or non-continuous fashion; however, automated apparatus for feeding, positioning, holding, or removing both fillers S and/or covers C may be provided, if desired. The book cover applicator depicted in the example of FIG. 1 is compact, lightweight, and can be placed on a table top or the like during operation, although other means of support, of course, may be provided, if desired.

The filler spine is coated entirely or at spaced intervals with a hotmelt adhesive. The adhesive is an adhesive which is a liquid at temperatures above its melting point and a solid polymer at ambient temperaure. Preferably the adhesive has a short setting time during which it changes from its liquid to solid form when cooled from a temperature above its melting point to ambient temperature. For best results, the adhesive in its solid form also should provide a strong, flexible bond between the sheets of the filler S and between the filler spine and cover C. It will be recognized, of course, that other types of adhesives may be used.

The filler S and cover C are secured in position on the support plate by two clamps: a sheet clamp 24 engageable with the topside of the main body of the filler S and a spine clamp 26 engageable with the spine and adjacent portion of the cover C once the front half of the cover has been folded about and conformably engaged withe the spine.

As best shown in FIGS. 1 and 3, the sheet clamp includes a generally flat, rectangular pressure plate 28 loosely supported between two mutually opposed horizontal end bars 30 to tilt relatively to the end bars such that the flat portions of the clamp plate underside conformably engage the topside of the main body of the filler S. The plate 28 is formed to include two spaced-apart V-shaped transverse channels, the forward of which is interengaged with a mounting rod 32 (FIG. 3) extending underneath the plate between the sheet clamp end bars. The rear end of the plate 28 is secured to the end bars by springs 34 (FIG. 3). The lower end of each spring 34 is secured to the rear edge of plate 28, while the upper end thereof is engaged with a pin 35 which projects from the adjacent end bar, as shown (FIG. 3). Vertical guide rods 36, fixed to the midsections of the end bars 30 and extending through the sheet clamp plate just forwardly of rear V-shaped channel thereof, are slideably movable up and down between guides 38 which are secured to the outer surfaces of the housing side walls. The guide rods 36 extend through coil springs 40 which seat on top of the guides 38. These springs engage and bias the sheet clamp plate 38 upwardly when the sheet clamp is pulled down and engages the filler S.

Figure 8:
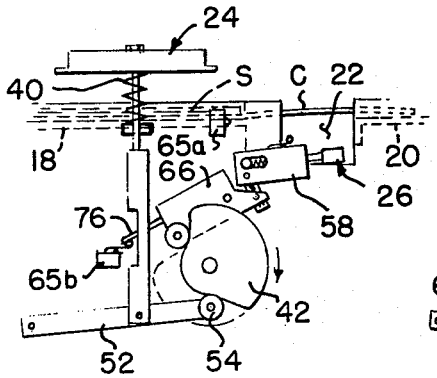
FIGS. 8–13 are schematic outlines depicting operation of the book cover applicator of FIG. 1.
Figure 9:
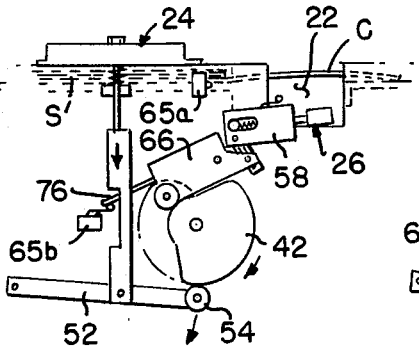
Figure 14:
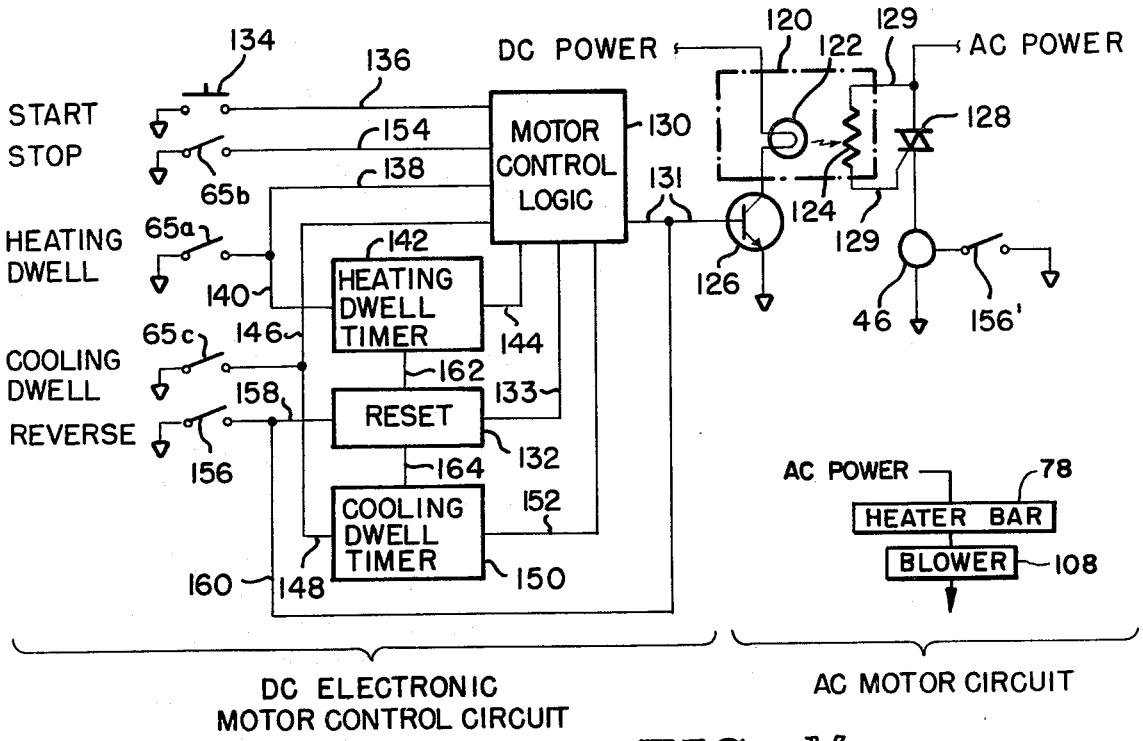
FIG. 14 is a circuit diagram of the electrical control system of the book cover applicator of FIG. 1.

The sheet clamp 24 is caused to vertically reciprocate by two outer cams 42 adjacent the respective outer surfaces the housing side walls (right outer cam not shown). These cams are secured to the ends of a cam shaft 44 extending between the housing side walls. An electric motor 46, mounted on the inside of the left side wall 10, as shown (FIG. 2), is connected with the left side of the cam shaft by a chain 48. When energized by the electrical control circuit of FIG. 14, presently to be described, this motor rotates the cam shaft 44. The guide rods 36 are adjustably connected at their lower ends to the upper ends of elongated, notched, vertical connecting arms 50 (right connecting arm not shown in FIGS. 1 and 3). Pivotally movable cam follower arms 52 are pivotally connected intermediate their ends with the lower ends of the connecting arms 50 to swing in a vertical plane adjacent the outer faces of the housing side walls. Follower rollers 54, rotatably mounted on the rear ends of the arms 52, are biased upwardly into engagement with the outer cams 42 by action of the springs 40. As these rollers follow the outer cam surfaces during rotation of the shaft 44, the arms 52 and, hence, the sheet clamp 24 are moved vertically between their clamping and release positions which are depicted in FIGS. 9 and 8, respectively.

The spine clamp 26 folds the cover C about the filler spine and clamps the interengaged portions of the cover and spine to the supporting plate adjacent the gluing station line. The spine clamp 26 includes an elongated nipper bar 56 having an upwardly inclined bottom face 57 (FIG. 3). The spine clamp nipper bar 56 extends between the housing side walls and projects at each end transversely outwardly therefrom. The nipper bar is mounted between two pivotally mounted arms 58 to swing vertically between a lower retracted position and an upright position. The retracted position is depicted in broken lines in FIG. 3 wherein the bar extends through and is nestled within the side wall recesses 22, and the upright position is depicted in solid lines in FIG. 3 wherein the bar registers with the cover and overlies the filler spine. Cam actuated heater means presently to be described drive the spine clamp from its lowered retracted position to its upright position. The bottom face 57 of the nipper bar allows the cover to remain in a semi-folded position and hence minimizes or eliminates creasing or scoring of the cover C when the spine clamp is in its upright position.

Both spine clamp arms 58 are rotatably supported on a two part pivot shaft (see FIG. 5) which includes an inner shaft 60 and an outer shaft 62 concentric with and movable independently of the inner shaft. The outer shaft 62 serves to mount the heater bar presently to be described. The spine clamp arms 58 are mounted on the outer ends of the inner shaft 60 which project outwardly from the housing side walls through elongated slots in the arms 58. The arms can slide along these slots relative to the shaft 60 between an extended position (FIGS. 3 and 13) and a contracted position (FIGS. 10 and 11) when the spine clamp is in its upright position. Compression springs 64, seen most clearly in FIG. 5, normally bias the spine clamp arms to their extended positions and cam means, presently to be described, produce a downward pull on the arms to clamp the nipper bar 56 against the cover and spine. As the left spine clamp arm is pulled downwardly away from its extended position, it engages and closes the first of three motor control switches **65*a*, 65*b* and 65*c* electrically connected with the control circuit of FIG. 14. The first motor control switch 65*a* is mounted on the outside of the left side wall as viewed in FIGS. 1 and 3**.

Figure 10:
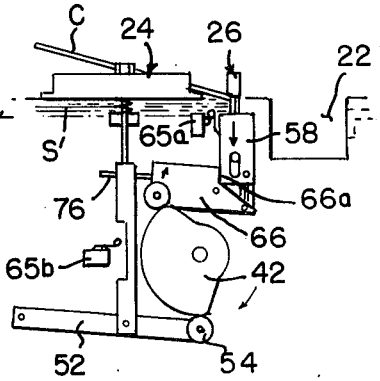

In addition to operating the sheet clamp 24 as described, the outer cams 42 further serve to operate the spine clamp arms 58 by causing them to move vertically between their extended and contracted positions. Rocker plates 66 are pivotally mounted to swing in respective vertical planes adjacent the outer faces of side walls and serve to interconnect the spine clamp arms 58 with the outer cams 42. The rocker plates 66 terminate at their rear ends adjacent the arms 58 in bifurcated extensions 68 which connect to slotted links 70. These links are pivotally connected at their upper ends with the lower ends of the spine clamp arms 58. Such movement of the rocker plates 66 is caused by cam follower rollers 72 (FIG. 3) mounted on the forward ends of the rocker plates. These rollers engage and follow the surface of the outer cams 42. Thus with the spine clamp arms 58 in their upright positions, upward movement of the front ends of the rocker plates 66 causes the arms 58 to be pulled downwardly against the bias of the springs 64 by virtue of their slotted engagement on the shaft 60. A shoulder **66*a* formed on the rear face of each rocker plate 66 engages and maintains the spine clamp arms 58 vertical when the rocker plates 66 are swung to their raised positions and the spine clamp is in its contracted position, as shown (FIG. 10). The springs 64 return their arms 58 to their extended positions as the plates 66 return to their lowered positions of FIG. 3. The second motor control switch 65*b* mounted on the outside of the left side wall is engaged and closed by an operator 76 projecting forwardly from the left rocker plate, when the left rocker plate reaches its lower position, depicted in FIG. 3**.

Figure 5:
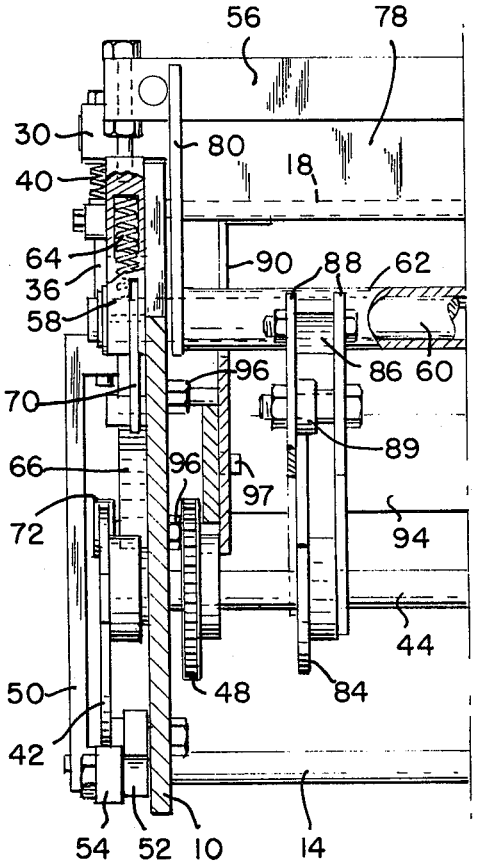
FIG. 5 is a fragmentary cross-section taken along lines 5—5 of FIG. 3 with parts broken away.

An electrical resistance heater bar 78, rectangular in cross-section, is mounted between pivotally movable arms 80 fixed to the outer shaft 62 of the two part pivot shaft (see FIG. 5). The heater bar 78 swings between a retracted position depicted in broken lines in FIG. 6 in which it is nestled within the side wall recesses 22 between the housing side walls and an upright position depicted in solid lines in FIG. 6 in which its forward face contacts the folded cover and filler spine. The right heater bar arm 80 engages and closes the third motor control switch 65*c* (FIGS. 1 and 6) when it is at its retracted or lowered position. The heater bar arms project above the upper edge of the heater bar 56, as seen most clearly in FIG. 1, and are engageable with the rear face of the spine clamp bar 56 such that the two are moved conjointly to their upright positions, as depicted in FIG. 6.

Figure 4:
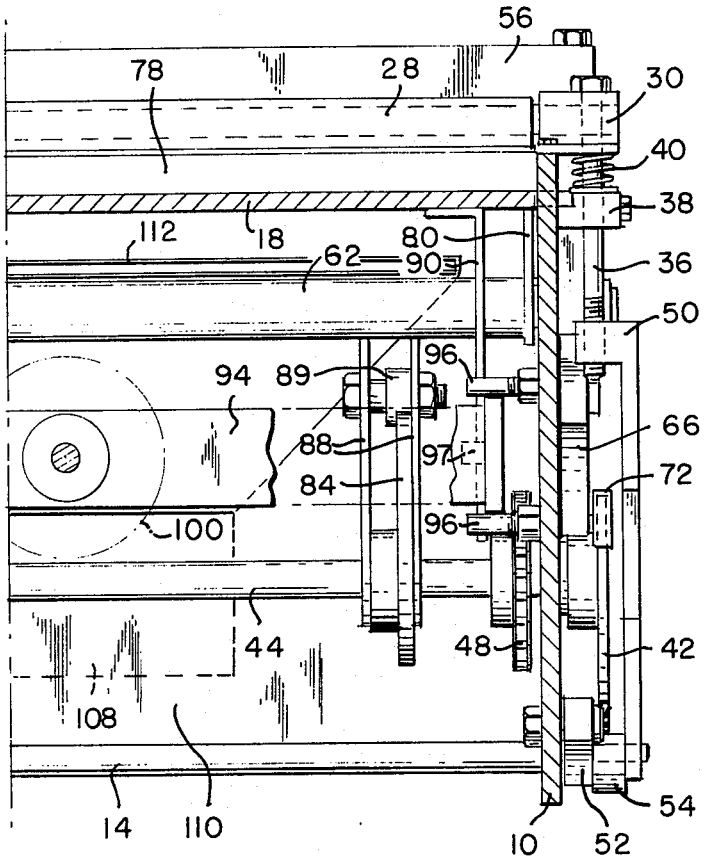
FIG. 4 is a fragmentary cross-section taken along lines 4—4 of FIG. 3 with the position of the blower shown in phantom.

The cam shaft 44 also mounts two spaced apart inner cams 84 for operating the heater bar between its upright and retracted positions. It is these inner cams which drive both the heater bar and the spine clamp from their retracted to their upright positions. Crank arms 86 are fixed to the outer shaft 62 and are pivotally connected to reciprocal follower plates 88 (see FIGS. 4 and 5), which are driven by the inner cams 84, to swing the heater bar vertically as the follower plates reciprocate in a vertically inclined direction indicated by the arrow in FIG. 6. The lower ends of the follower plates 88 are provided with an elongated slot 87 (FIG. 6) in which the cam shaft 44 is slideably engaged. Follower rollers 89, which are mounted between each pair of follower plates intermediate the lengths thereof, engage the surfaces of the inner cams. As these rollers follow the contour of the inner cams 84, the follower plates are reciprocated in the vertically inclined direction indicated, and hence the heater bar is swung between its upright and retracted positions.

To accommodate fillers of varying thickness, the support plate can be raised and lowered so that the upper face of the filler S is substantially flush with the upper edges of the housing side walls. As most clearly shown in FIGS. 4, 5 and 7, the forward and rear support plates 18 and 20 are supported at each side by left and right vertical positioning plates 90 and 92 which are interconnected by a U-shaped horizontal operator member 94 (shown in plain view in dotted lines in FIG. 2). The operator member is supported between spaced-apart pairs of mounting pins which project inwardly from each side wall. Each of the positioning plates 90 and 92 includes an upper recess which registers with the side wall recesses 22 and oppositely inclined end edges which merge with generally vertical, parallel side edges 95. The side edges 95 are slideably engaged between the side wall mounting pins 96 such that the positioning plates are movable vertically between and guided by these pins. The operator member 94 includes connecting pins 97 which project through parallel inclined slots 98 in the positioning plates, as shown (FIG. 7), such that horizontal reciprocation of the operator member 94 along the longitudinal axis of the housing causes the positioning plates to be raised and lowered. The forward mid-point of the operator member 94 is threadably engaged with an external hand crank actuator 100 mounted in the housing front wall 16. This actuator may be operated to reciprocate member 94 along the longitudinal axis of the housing to simultaneously raise or lower the front and rear support plates 18 and 20 respectively.

Figure 7:
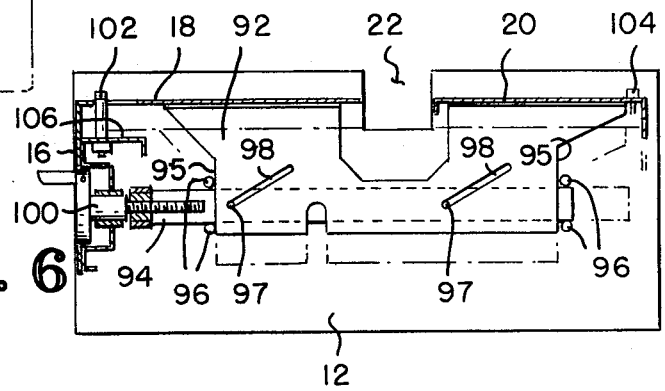
FIG. 7 is a cross-section taken along lines 7—7 of FIG. 2 with parts broken away.

To accomodate and align fillers S and covers C of varying lengths relative to the gluing station, forward positioning pins 102 and a single rear pin 104 may be provided. The forward positioning pins 102 project above the surface of the support plate 18 and are secured to a flange 106 mounted on the front wall of the housing, as shown (FIG. 7). The rear positioning pin 104 is secured to and projects above the surface of the support plate 20, as shown (FIG. 7). The positions of the forward and the rear positioning pins may be varied along the longitudinal axis of the housing as desired.

A blower 108 (FIGS. 1–3), supported by a vertical mounting plate 110 secured between the rear rods 14, terminates in a horizontally disposed elongated nozzle 112 which extends perpendicular to the longitudinal axis of the housing. The nozzle is located so as to direct cooling air against the cover and filler spine at the gluing station.

OPERATION

Operation of the book cover applicator of this invention will now be described with reference to FIGS. 3, 6, and 8–13 of the drawings.

With the book cover applicator in the condition depicted in FIG. 8, the cover C is laid flat on the support plate, one half of the cover resting upon the support plate 18 and the other half of the cover bridging the housing side wall recesses 22 and resting flat on the support plate 20. The cover score lines along which the cover is bent and applied to the filler spine are located adjacent the cover application station line. A filler S, having its spine coated with a hotmelt adhesive, is then laid flat on top of the cover C on the forward support plate 18 with its spine aligned with the appropriate score line of the cover adjacent the cover application station line.

The cam drive motor 46, when energized, simultaneously rotates the inner and outer cams 84 and 42 in a clockwise direction as indicated by the arrows in FIGS. 3, 6 and 8–13. As the outer cams 42 move from the position shown in FIG. 8 to that shown in FIG. 9, the sheet clamp cam follower arms 52 are driven downwardly and, hence, the sheet clamp 24 is drawn downwardly into engagement with the top surface of the main body of the filler S against the bias of the springs 40. Thereafter, as depicted in FIG. 6, the inner cams 84 contact the rollers 89 to drive the heater bar follower plates 88 in an upward inclined direction so as to swing both the heater bar 78 and the spine clamp 26 from their retracted to their upright positions. As the spine clamp is thus swung to its upright position, it engages the underside of the rear or free portion of the cover C and folds the cover in half about its score lines such that the cover C conformably engages the filler spine. At its upright position, the front face of the heater bar 78 contacts the interengaged cover and filler spine and begins to apply heat to the hotmelt adhesive on the spine. As outer cams 42 continue to rotate, they cause the spine clamp arms 58 to be drawn downwardly toward their contracted or clamping positions at which the lower inclined face of the spine clamp nipper bar will engage the spine and the portion of the cover C engaged therewith, as depicted in FIG. 10.

Figure 11:
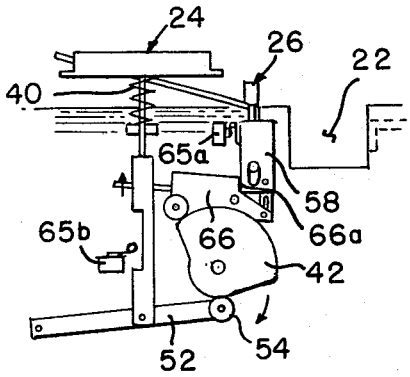
Figure 12:
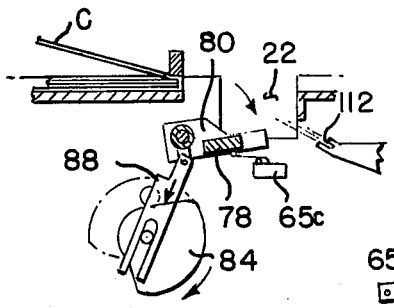

Before the spine clamp reaches its clamping position, however, the first motor control switch 65*a* is closed. (This takes place just after the spine clamp is pulled downwardly from its upright position of FIG. 3 but before it reaches its clamping position of FIG. 10). The first motor control switch 65*a* actuates a heating dwell timing circuit (FIG. 14) and causes the cam drive motor 46 to be de-energized momentarily. Thus, rotation of the inner and outer cams is halted for a time interval of sufficient duration to allow the hotmelt adhesive to be melted sufficiently to its liquid form to coat both the filler spine and the portion of the cover C engaged therewith. Inasmuch as heat application takes place before the spine clamp engages the filler spine and cover C, uniform melting of the glue can occur such that lumps and similar discontinuities in the glue are allowed to spread evenly, and heat is distributed uniformly. At the end of the heating dwell time interval, the drive motor is again energized and the inner and outer cams continue to rotate in the clockwise direction and the spine clamp reaches its clamping position (FIG. 10). Now the sheet and spine clamps, and the heater bar simultaneously engage the filler spine and the cover C. Such simultaneous engagement aligns the filler spine and cover, and ensures that the now molten glue will spread between and contact both. As depicted in FIG. 11, further clockwise rotation of the outer cams 42 allows the sheet clamp 24 to be returned to its raised position under the bias of the springs 40. At about the same time, the inner cams 84 have rotated sufficiently to allow the heater bar follower plates 88 to slide downwardly a sufficient distance to allow the heater bar to swing downwardly to its retracted position, as depicted in FIG. 12. The rocker arm shoulders 66*a* hold the spine clamp upright in its clamping position.

Figure 13:
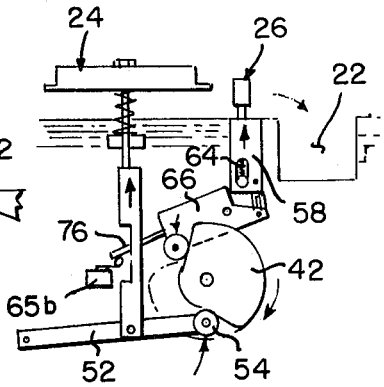

Upon the right heater bar arm 80 reaching its retracted position, the third motor control switch 65*c* is closed. This switch actuates a cooling dwell timing circuit (FIG. 14) and again momentarily de-energizes the cam drive motor, thus halting rotation of the inner and outer cams for a time interval of sufficient duration to allow the hotmelt adhesive to cool and set. During this cooling dwell the spine and cover are engaged by the spine clamp alone. Once set, the hotmelt adhesive provides a strong, flexible bond between the filler spine and cover. To assist cooling the hotmelt adhesive, the blower 108 and nozzel 112 direct an air blast against the now exposed cover and filler spine. Preferably, the blower operates continuously as does the heater bar. At the end of the cooling dwell time interval provided by the cooling dwell timing circuit, the drive motor is again energized and clockwise rotation of the inner and outer cams continues. As depicted in FIG. 13, such continued rotation of the outer cams 42 allows the spine clamp arms 58 to first return to their extended positions under the bias of their compression springs 64 and then swing downwardly until the spine clamp 26 resumes its retracted position.

The second motor control switch 65*b* is closed when the left spine clamp rocker arm 66 reaches its lowered position depicted in FIGS. 13 and 8. This switch causes the drive motor to be de-energized at the end of the cover application process. The sheet and spine clamps are now in their original positions of FIG. 8 ready for application of another cover C.

ELECTRICAL CONTROL SYSTEM

With operation of the book cover applicator of this invention in mind, the electrical control system of this invention will now be described with reference to FIG. 14 of the drawings.

The electrical control system is made up of a DC electronic motor control circuit which includes the above-mentioned three motor control switches 65*a*–65*c*, and an AC motor circuit which includes the cam shaft drive motor 46. These two circuits are respectively connected electrically with sources of DC and AC power. They are coupled to each other by an optical isolator 120 of conventional design which comprises an incandescent light 122 and a photoresistor 124 which are electrically connected in the DC and AC circuits, respectively. A transistor 126 controls DC current flow through the light 122. When this transistor is in its conductive state, light 122 emits light which lowers the resistance of the photoresistor 124. A triac 128 in the AC motor circuit and connected by leads 129 with the photoresistor 124, as shown, becomes conductive when the resistance of the photoresistor 124 is lowered to a certain level. The cam shaft drive motor 46 is then energized with AC power and begins rotating the cam shaft, as described above. The heater bar and blower are operated continuously by the same or a generally similar AC power source as that associated with the AC motor control circuit as indicated schematically in FIG. 14.

The conductive and nonconductive states of the transistor 126 are controlled by a motor control logic circuit 130 of conventional design. This circuit is connected by lead 131 with the base of transistor 126. A reset circuit 132 produces a signal in lead 133 to clear the logic circuit 130 when DC power is first applied to the DC motor control circuit. To initiate a cover application sequence, which begins with the filler, cover, and applicator in their positions of FIG. 8, start switch 134 is momentarily closed manually. The logic circuit 130 receives the signal from start switch 134 along lead 136 and causes the transistor 126 to become conductive, thus energizing the drive motor 46 which rotates the cam shaft 44 as described above.

When the first motor control or heating dwell switch 65*a* is closed in response to downward movement of the spine clamp 26 toward its clamping position (see FIG. 10), a signal is produced in lead 138 to the logic circuit 130 which causes the transistor 126 to become nonconductive, thus de-energizing the drive motor 46 which halts rotation of the cam shaft. A second signal is produced simultaneously in lead 140 to a heating dwell timing circuit 142. This circuit includes conventional time delay circuitry, the time constant or time delay of which can be varied by means of an external adjustment (not shown). Thus, it is possible, by selecting a time delay of sufficient duration, to use different types of hotmelt adhesive having differing melting times. At termination of the heating dwell, the timing circuit 142 transmits a signal along lead 144 to the logic circuit 130 which then causes transistor 126 again to become conductive, thus re-energizing the drive motor 46 which continues rotating the cam shaft.

When the third motor control or cooling dwell switch 65*c* is closed in response to return of the heater bar to its retracted position (see FIG. 12), a signal is produced in lead 146 to the logic circuit 130 which again causes the transistor to become nonconductive, thus de-energizing the drive motor 46 which halts cam shaft rotation, as before. A second signal is produced simultaneously in lead 148 to a cooling dwell timing circuit 150, the output of which is connected with the logic circuit 130 by lead 152. This circuit is generally similar to the heating dwell timing circuit 142 described previously and can be adjusted to enable use with hot-melt adhesives of differing setting times. At termination of the cooling dwell, the timing circuit 150 causes the drive motor to be re-energized, as before.

When the second motor control or stop switch **65*b* is closed in response to return of the left rocker plate to its lowered position (see FIGS. 8 and 13), a signal is produced in lead 154 to the logic circuit 130 which cause the drive motor 46 to be de-energized and cam shaft rotation halted, as before. The applicator is now in its initial position of FIG. 8**.

To reverse the drive motor 46 at any time during the cover application process, a reverse switch is provided. This switch includes a DC component 156 and an AC component 156'. When operated, the DC component 156 produces signals in leads 158 and 160 which are respectively connected with the reset circuit 132 and with the logic circuit output lead 131. In response to the signal in lead 158, the reset circuit 132 transmits signals along leads 162 and 164 to the heating and cooling dwell timing circuits 142 and 150, respectively. These signals prevent operation of both timing circuits until electrical transients produced by reversal of the drive motor have dissipated from the electrical system. The reset circuit 132 also clears the logic circuit 130, as before. The signals produced in lead 160 cause transistor 126 to become conductive and hence cause the drive motor to be energized. Simultaneously, the AC switch component 156' causes the now energized drive motor to reverse its direction of rotation.

Figure 15:
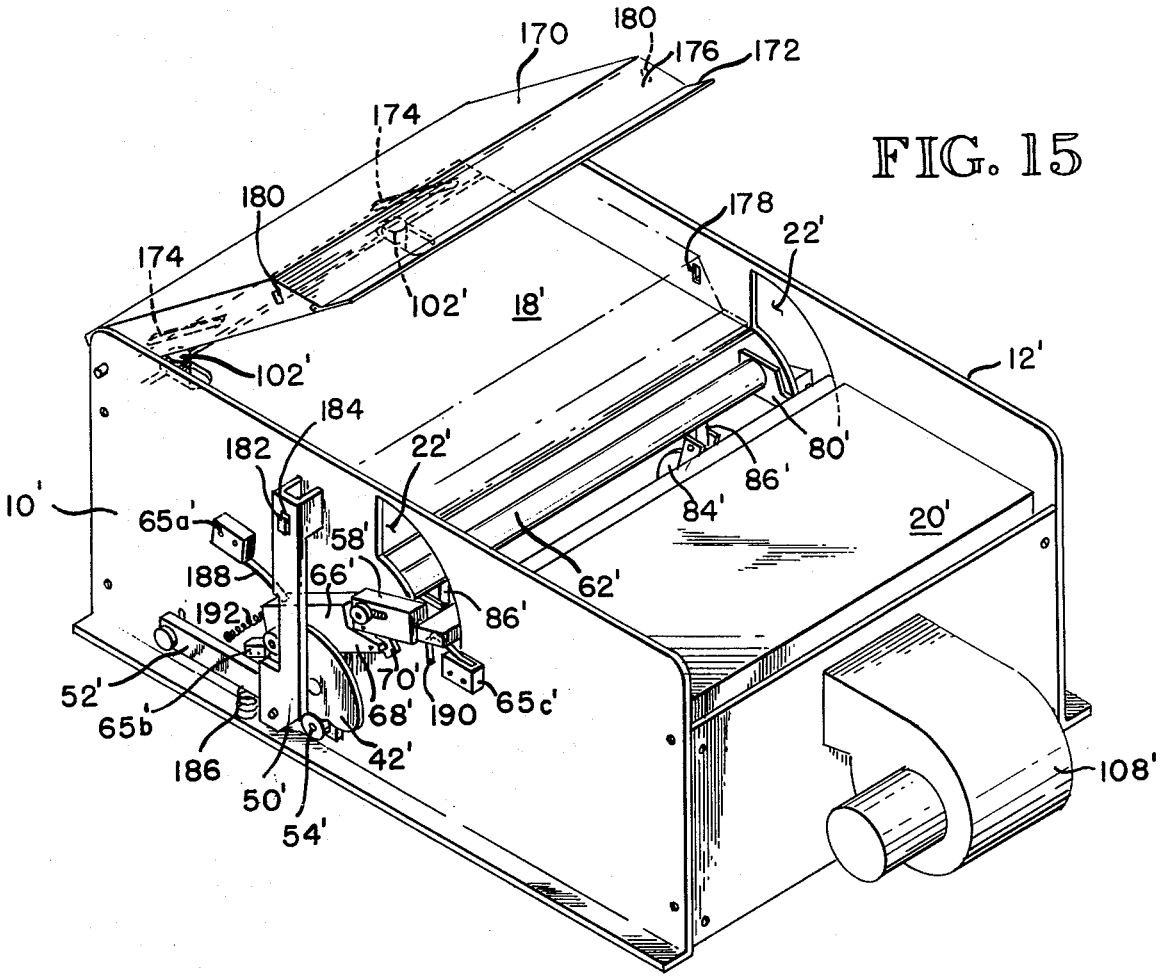
FIG. 15 is a perspective view of a second preferred embodiment of the book cover applicator of this invention.

A second preferred embodiment of this invention illustrated in FIG. 15 includes a modified and preferred form of the sheet clamp. The applicator is depicted in solid lines in condition for initiation of a cover application sequence with the spine and sheet clamps, and the heater bar retracted. Parts corresponding to those already illustrated and described are designated with the same reference numberals primed.

The sheet clamp of FIG. 15 includes a generally flat cover 170 and a pressure plate 172 which is pivotally connected to the rear edge of the cover. The cover 170 has an outline which corresponds to the outline of the filler S and is pivotally supported between the front upper corners of the housing side walls 10' and 12'. The cover 170 swings up and down between an inclined loading or retracted position, depicted in solid lines, in which the filler S and cover C can be placed upon the applicator, and a horizontal clamping position, depicted in broken lines, in which the lower face of the cover 170 opposes the forward support plate 18' and presses flat against the filler S and cover C. The underside of the cover 170 includes two spaced apart elongaged holes 174 into which the forward positioning pins 102' are respectively inserted when the cover 170 is in its horizontal clamping position. The rear edge of the pressure plate 172 fronts along the gluing station line when the sheet clamp is in its horizontal clamping position. The cover 170 further includes an inclined rear surface 176 over which the cover C extends when it is folded in half about the filler spine.

The pressure plate 172 is maintained, by spring means not shown, in a position parallel to the lower face of the cover 170, as shown (FIG. 15); however, to minimize disturbance to the glue joint as the sheet clamp is swung from its horizontal clamping to its loading position during the cover application sequence, the pressure plate 172 can be pivoted downwardly as it engages and is drive downwardly by the overlapping folded half of the cover C.

In the second preferred embodiment, the vertical connecting arms 50' lock the cover 170 in its clamping position. The cover 170 is moved manually to and from its horizontal clamping position. The vertical connecting arms 50' terminate in shoulders (not shown) which can project inwardly through vertical slots 178 in the housing side walls 10' and 12' and engage slots 180 in the sides of cover 170 to lock the sheet clamp in its horizontal clamping position. These shoulders are driven inwardly by inclined cams 182, which are secured to the outer surfaces of the sidewalls 10' and 12' and project through vertical slots 184 formed in the upper ends of the arms 50', into locking engagement with the cover slots 180 as the arms 50' are pulled down by the follower arms 52'. The shoulders are driven outwardly by generally similar oppositely inclined cams (not shown) as the arms 50' are pushed upwardly by compression springs 186 which engage the bottoms of the follower cams 52'.

The motor control switches **65*a'*–65*c'* of the applicator depicted in FIG. 15 may be operated and connected in the electrical control circuit of FIG. 14 and are generally similar to the switches already described; however, they are mounted to be responsive to the positions of different structural members. Switch 65*a'* is closed when an operator 188 is engaged and moved upwardly by the left rocker plate 66'. Switch 65*b'* is engaged and closed by the lower forward corner of the left rocker plate 66' when the latter reaches its lowered position, as shown. Switch 65*c'* is closed when an operator 190 is engaged by a pin (not shown) projecting outwardly from the left end of the heater bar 78' (not shown in FIG. 15**).

A tension spring 192 pulls the forward end of the left rocker plate 66' against the surface of the left outer cam 42'. This rocker plate, of course, may be weighted and this spring eliminated.

While two preferred embodiments of this invention have been illustrated and described herein, it will be apparent that variations will become apparent to one skilled in the art. Accordingly, the invention is not to be limited to the specific embodiments illustrated and described herein and the true scope and spirit of the invention are to be determined by reference to the appended claims.

The embodiments of the invention in which an exclusive property or privilege is claimed are defined as follows:

1. A book cover applicator for applying a cover to a filler having a spine coated with a heat activatable adhesive, said applicator comprising: sheet contact means including a sheet support surface for positioning the filler and cover with the spine and a portion of the cover at a cover application station located adjacent said support surface; and bonding means mounted adjacent said cover application station for activating the spine adhesive by heat application and then effecting an adhesive bond formed by the spine adhesive between the spine and said cover portion, said bonding means including an elongated heat application element movable to and from a heat application position in thermally conductive relation with the spine adhesive.

2. The applicator of claim 1, further comprising cooling means mounted adjacent said cover application station and operative upon termination of heat application to cool the spine adhesive.

3. The applicator of claim 2 wherein said cooling means includes a blower which directs air toward said gluing station.

4. The applicator of claim 1 wherein said heat application element includes an electrical resistance heater bar.

5. The applicator of claim 1 wherein said sheet contact means comprises: a sheet clamp mounted adjacent said support surface to be movable to and from a clamping position in which it engages the main body of the filler, a spine clamp mounted adjacent said support surface to be movable to and from a clamping position in which it engages the spine and cover; and further comprising cam actuator means for moving the sheet and spine clamps, and said heat application element to their respective clamping and heat application positions; and control means responsive to the positions of said spine clamp and said heat application element for operating said cam actuator means, said control means de-actuating said cam actuator means during heating and cooling of the spine adhesive.

6. The applicator of claim 1 wherein said sheet contact means comprises: an elongated member; means mounting said member adjacent said support surface for reciprocal movement to and from a clamping position in which it engages the main body of the filler.

7. The applicator of claim 1, wherein said heat application element further is movable so as to engage and fold the cover about the spine while moving toward its heat application position.

8. A method for applying a cover to a filler having a spine coated with a heat activatable adhesive, said method comprising the steps of:

activating the spine adhesive by heat application;

deactivating the spine adhesive by cooling while engaging the spine with the cover for a time period sufficient to produce an adhesive bond formed by the spine adhesive between the spine and cover;

applying hold-down pressure to the filler and cover only at a location spaced from the spine prior to completion of said activating step;

simultaneously applying hold-down pressure to the filler and cover at said location and adjacent the spine upon completion of said activating step until initiation of said deactivating step; and applying hold-down pressure to the filler and cover only adjacent the spine during said deactivating step.

9. A book cover applicator for applying a cover to a filler having a spine coated with a selectively activatable adhesive, said applicator comprising: sheet contact means including a sheet support surface for positioning the filler and cover with the spine and a portion of the cover at a cover application station located adjacent said support surface; bonding means mounted adjacent said cover application station for activating the adhesive and then effecting an adhesive bond formed by the spine adhesive between the spine and said cover portion; said sheet contact means further including a cover member having an outline which substantially registers with the outline of the filler, and means mounting said cover member adjacent said support surface for pivotal movement to and from a clamping position in which it engages the main body of the filler.

10. A book cover applicator for applying a cover to a filler having a spine coated with a selectively activatable adhesive, said applicator comprising: sheet contact means including a sheet support surface for positioning the filler and cover with the spine and a portion of the cover at a cover application station located adjacent said support surface; bonding means mounted adjacent said cover application station for activating the spine adhesive and then effecting an adhesive bond formed by the spine adhesive between the spine and said cover portion; said sheet contact means further including edge contact means upstanding from said support surface for engaging the opposite edge of the filler and aligning the spine relative to said cover application station.

11. A book cover applicator for applying a cover to a filler having a spine coated with a selectively activatable adhesive, said applicator comprising: sheet contact means including a sheet support surface for positioning the filler and cover with the spine and a portion of the cover at a cover application station located adjacent said support surface; bonding means mounted adjacent said cover application station for activating the spine adhesive and then effecting an adhesive bond formed by the spine adhesive between the spine and said cover portion; and vertical adjustment means for raising and lowering said support surface.

12. A book cover applicator for applying a cover to a filler having a spine coated with a heat activatable adhesive, said applicator comprising: a sheet support surface on which the filler and cover are positionable; bonding means mounted adjacent said sheet support surface for activating the spine adhesive, and then deactivating the spine adhesive while engaging the cover with the spine for a time period sufficient to produce an adhesive bond between the spine and cover; and sheet hold-down means operatively associated with said sheet support surface and said bonding means for applying hold-down pressure to the filler and cover only at a location spaced from the spine during adhesive activation, and only adjacent the spine during adhesive deactivation, said bonding means including heat application means movable toward a bonding position adjacent said sheet support surface for activating the spine adhesive by heat application, and for engaging the cover with the spine during such movement.

13. A book cover applicator for applying a cover to a filler having a spine coated with a selectively activatable adhesive, said applicator comprising: a sheet support surface on which the filler and cover are positionable; bonding means mounted adjacent said sheet support surface for activating the spine adhesive, and then deactivating the spine adhesive while engaging the cover with the spine for a time period sufficient to produce an adhesive bond between the spine and cover; and sheet hold-down means operatively associated with said sheet support surface and said bonding means for applying hold-down pressure to the filler and cover only at a location spaced from the spine during adhesive activation, and only adjacent the spine during adhesive deactivation, said hold-down means including sheet clamp means for engaging the main body of the filler at a location spaced from the spine, and spine clamp means for engaging the spine.

14. A book cover applicator for applying a cover to a filler having a spine coated with a selectively activatable adhesive, said applicator comprising:

means for simultaneously securing both the filler and cover in positions wherein the spine and a portion of the cover are at a cover application station, by selectively clamping both the filler and cover in such positions;

bonding means located adjacent said cover application station for activating the adhesive and then effecting an adhesive bond formed by the spine adhesive between the spine and said cover portion; and means for moving said bonding means to and from an activation position whereat it activates the adhesive, said bonding means including a member which contacts the cover during movement of the bonding means to said activation position so as to bring said cover portion into contact with the spine.

15. A method for applying a cover to a filler having a spine coated with a selectively activatable adhesive, said method comprising the steps of:

simultaneously securing both the filler and cover in positions wherein the spine and a portion of the cover are at a cover application station, by selectively clamping both the filler and cover in such positions;

moving bonding means located adjacent said cover application station into a position whereat it can activate the adhesive and then effect an adhesive bond formed by the spine adhesive between the spine and said cover portion;

simultaneously contacting the cover with a member of said bonding means so as to bring said cover portion into contact with the spine; and then activating the adhesive with the bonding means.

* * * * *